United States Patent [19]

Weber et al.

[11] Patent Number: 4,856,478

[45] Date of Patent: Aug. 15, 1989

[54] VACUUM CONTROL VALVE

[76] Inventors: James H. Weber, 888 South Dexter St. #602, Denver, Colo. 80228; Rodney H. Cornish, 6966 South Franklin St., Littleton, Colo. 80122

[21] Appl. No.: 132,956

[22] Filed: Dec. 14, 1987

[51] Int. Cl.[4] ..... F02P 5/12

[52] U.S. Cl. ..... 123/407

[58] Field of Search ..... 123/407, 408, 409, 425; 251/12, 14, 26, 281, 282, 141, 204, 357, 333, 334

[56] References Cited

U.S. PATENT DOCUMENTS

| | | | |
|---|---|---|---|
| 4,327,686 | 5/1982 | Ricci | 123/407 |
| 4,622,937 | 11/1986 | Szloboda | 123/407 |
| 4,683,853 | 8/1987 | Szloboda | 123/407 |

*Primary Examiner*—Raymond A. Nelli

*Attorney, Agent, or Firm*—Timothy J. Martin; J. Preston Oxenham

[57] ABSTRACT

A vacuum control valve logically selects between a pair of variable vacuum sources to provide a vacuum to a vacuum use station such that the supplied vacuum is the greater of the two vacuums (the lesser of the pressures). The valve has a main body with a longitudinal passageway extending between first and second inlets connectable to the vacuum sources. An outlet connectable to the vacuum use station is located centrally of the passageway and communicates therewith. A pair of valve elements are located in the passageway and operate to open and close fluid communication between the outlet and the two inlets so that the inlet having the greater vacuum is open for communication while the inlet with the lesser vacuum is closed. Preferably, the valve elements are mechanically connected to one another by a hollow spindle provided with outer ports adjacent each valve element and a central port which communicates with the outlet. Each valve elements seats and unseats against a respective valve seat formed in the passageway. The valve elements can thus toggle when the relative vacuums of the two sources are approximately equal with the spindle and valve elements provide inertial mass to smooth transitions between the two vacuum sources.

16 Claims, 4 Drawing Sheets

VACUUM CONTROL VALVE

FIELD OF THE INVENTION

The present invention generally relates to vacuum control valves but is specifically directed to a vacuum control valve operative to switch a vacuum use station between a pair of vacuum sources such that the vacuum supplied to the vacuum use station is always the greater vacuum (lower pressure) of the two varying vacuum sources. The present invention finds specific application for use on the vacuum advance ignition system of an engine driven motor vehicle.

BACKGROUND OF THE INVENTION

While various valve devices have been developed for use in controlling fluid flows, including the flow of air or gas, a majority of these valves are singlestage valves which respond to pressure either to open or close. Many of these valves rely on spring biasing structure in order to counteract a pressure force. For example, pressure relief valves are biased into a closed position, but, when the pressure exceeds a threshold established by the biasing spring, the valve opens to allow release of pressure. The spring then closes the valve once the pressure drops below the threshold. Dual valves are known wherein the dual valve connects a pair of pressure sources to a pressure use station such that the use station receives the maximum pressure available from either of the pressurized sources.

A different problem is presented in the automobile industry, however, where both the efficiency of an internal combustion engine and the volume of pollutants produced by the engine are a function of the carburation and ignition timing for the combustive process. It has long been established that, for a reciprocating internal combustion engine, greater power is accomplished and the engine runs more efficiently when an ignition spark is produced at an appropriate point prior to the completion of a compression stroke of the piston head in the piston cylinder. This ignition is preferred to be a few degrees before the maximum compression. Furthermore, it is has been known that the amount of advancement of the spark is a function of the flow of the mixed fuel product (gasoline and air) to the cylinder. Thus, internal combustion engines that have carburetors to mix the fuel product are also provided with a vacuum advance system wherein the venturi vacuum of the carburetor is connected to a structure on the ignition system such that the faster the fuel product flows through the carburetor the more the ignition spark is advanced to the cylinders.

In recent years there has been a tendency in the automotive industry to move away from distributive ignition systems and focus, instead, on electronic ignition systems wherein the timing of the combustive spark is controlled by a microprocessor circuit rather than the traditional vacuum advance. The movement of the industry towards electronic ignition significantly stems from the desire to optimize performance of the engine while minimizing hydrocarbon and carbon monoxide emissions. Indeed, governmental agencies have legislated emission standards throughout the United States in an effort to benefit air quality in and around the major urban centers. It is not untypical for such legislation to have a scale of maximum acceptable emissions for hydrocarbons and carbon monoxide based upon the year of manufacture of the vehicle. The modern advances in computer controlled electronic ignitions have been a significant step in meeting these emission standards.

However, the fact remains that a large number of older vehicles are still in service, and these older vehicles contribute substantially to the aggregate hydrocarbon and carbon monoxide emissions in a region, especially in urban environments. These older vehicles are prevalent in states which have moderate climates or otherwise do not implement corrosive winter road surface agents thereby extending the useful lives of the older vehicles. In many of these states a climatic condition known as "temperature inversion" exists and can cause very poor air quality in congested areas.

These older vehicles typically have the traditional vacuum advance ignition systems described above. While the mechanical vacuum advance system helps an internal combustion engine run more optimally with less pollution at normal driving speeds, this system suffers a significant drawback when the engine is merely idling, when the operator is shifting gears, or when the mixed fuel product flow is otherwise minimal such as might occur during deceleration. The reason for this is that the vacuum advance system relies upon the venturi vacuum of the vehicle's carburetor; when the engine is idling or is otherwise not receiving substantial fuel product flow through the carburetor, the venturi vacuum is negligible even though the engine is running. Hence, during these times, the engine must run rich since the vacuum is not advanced. This excessive fuel results in incomplete combustion thereby tremendously increasing the amount of hydrocarbons and carbon monoxide exhausted by the vehicle. In those urban centers where pollution is most acute, the large volume of automobiles, the stop-and-go driving and the large number of commuting residents only magnify this problem.

The present invention addresses this problem in an effort to provide a simple control valve that, while having broader application, is specifically constructed for use in conjunction with the vacuum advance system of a vehicle so as to reduce the amount of pollutants generated during operation of that vehicle. Thus, the present invention retrofits on vehicles having internal combustion engines having an ignition system with a mechanical vacuum advance.

SUMMARY OF THE INVENTION

It is an object of the present invention to provide a new and useful control valve operative to connect two vacuum sources to a vacuum use station.

It is another object of the present invention to provide a simple mechanical valve which is inexpensive in construction and which supplies a vacuum use station with the greater of two vacuums (the lessor of two pressures) from a pair of varying vacuum sources.

It is yet another object of the present invention to provide a vacuum control valve that mechanically and logically selects between a pair of vacuum inputs so that the output of the logical valve is the more intense vacuum of the two inlets.

A still further object of the present invention is to provide a vacuum control valve for use with an internal combustion engine having an intake manifold, a carburetor with a vacuum venturi, and an ignition system with a vacuum advance so that the ignition system is advanced corresponding to the greater vacuum of the venturi vacuum and the manifold vacuum.

It is a still further object of the present invention to provide a control valve for an internal combustion engine which may be interposed in an existing vacuum advance system so as to allow the vacuum advance system to logically select and be controlled by the more intense vacuum between the venturi vacuum and the manifold vacuum.

The present invention, then, is broadly directed to a vacuum control valve operative to connect a vacuum use station to first and second vacuum sources such that the vacuum use station is supplied and affected by the greater of the vacuums (lesser of the pressures) of the two sources. The control valve is constructed as a body portion that has an internal flow passageway that has a first inlet connectable in fluid communication with a first vacuum source, a second inlet connectable in fluid communication with the second vacuum source and an outlet connectable in fluid communication with the vacuum use station. First and second valve elements are mounted in the passageway and are responsive to the relative pressures at the first and second inlet. Each valve element moves between an open position permitting communication between its respective inlet and a closed position prohibiting fluid communication between its respective inlet and the outlet. The valve elements are configured to be responsive to the relative pressures of the two vacuum sources such that the first valve element is in the open position and the second valve element in the closed position when the pressure of the first vacuum source is less than the pressure of the second vacuum source. Further, the first valve element is in the closed position and the second valve is in the open position when the pressure of the second vacuum source is less than the pressure of the first vacuum source. When the pressures of the two sources are approximately equal, perturbations in their relative pressures cause the vacuum elements to toggle between their open and closed position to provide a mixed vacuum signal to the output.

Preferably, the control valve is constructed for use in an engine-driven vehicle which has an intake manifold, a carburetor with a vacuum venturi, and an ignition system provided with a mechanical vacuum advance which is normally connected to the vacuum venturi. In this use, the vacuum control valve has its outlet connected to the vacuum advance, a first inlet connected to the vacuum venturi and a second inlet connected to the intake manifold vacuum. Thus, the vacuum venturi defines the first vacuum source and the manifold vacuum defines a second vacuum source with the vacuum advance system defining the vacuum use station.

Preferably, the body portion of the valve is elongated in shape and the passageway is formed longitudinally therein such that the first and second inlets are on opposite ends of the passageway. The passageway may have a central portion of reduced diameter that forms first and second valve seats which respectively face the first and second inlets. The first valve element is then constructed as a first plug sized to seat against the first valve seat in the closed position and a second plug element sized to seat against the second valve seat in the closed position. Each of the valves may be provided with sealing gaskets, and guide means may be provided for respectively aligning the plugs as each moves between the open and closed position. Preferably, the guides include first and second spindle portions which project toward one another into the central portion of the passageway. Further, it is preferred that these spindle portions be connected together to form a common spindle having a common interior mechanically joining the first and second plugs for common reciprocal movement. Ports are then provided adjacent each of the first and second plugs, and a central port is provided to communicate with the outlet so that flow communication is established between the open valve through its associated port, through the hollow interior of the spindle, and through the central port to the outlet. The spindle and first and second plugs thus form an inertial mass operative to affect the rate of transition between the open and closed positions for the valve.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention is directed to a control valve operative to switch a use station between a pair of vacuum sources such that the use station is supplied with the more intense vacuum from the two sources. Thus, for purposes of the present description, it should be understood that reference to the greater of two vacuums means that vacuum which is at the lower pressure. The present invention is specifically adapted for use in conjunction with an internal combustion engine wherein the vacuum use station comprises the vacuum advance of a traditional mechanical ignition system and the vacuum sources correspond to the vacuum venturi of a carburetor and the intake manifold vacuum of the engine. Accordingly, the present control valve may be used as an original equipment item on those vehicles provided with a traditional ignition system rather than a computer controlled electronic ignition and may also be used as a retrofit item for vehicles, especially older vehicles, provided with the mechanical ignition system.

Figure 1:
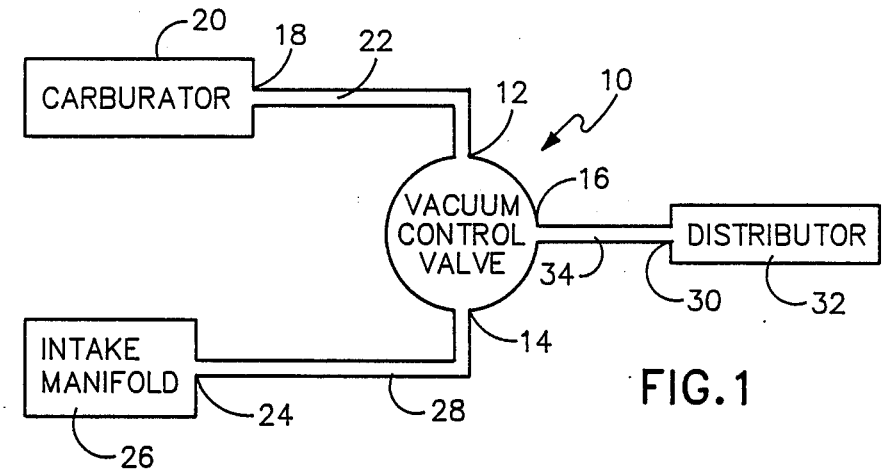
FIG. 1 is a diagrammatic view of the control valve according to the present invention shown in its preferred use in conjunction with operative portions of an internal combustion system for a vehicle.

Turning to FIG. 1, the present invention is shown, in diagrammatic form, connected to the operative components of an internal combustion engine. Here, vacuum control valve 10 has a first inlet 12, a second inlet 14 and an outlet 16. First inlet 12 is connected in fluid communication to vacuum venturi 18 of carburetor 20 by means of conduit 22. Second inlet 14 is connected to a vacuum port 24 on intake manifold 26 by means of conduit 28. Outlet 16 is connected to vacuum advance 30 of distributor 32 by means of conduit 34. It should be appreciated from this description that, in the traditional ignition system, conduit 22 is directly connected to vacuum advance 30. However, in the present invention, conduit 22 is connected only to first inlet 12. Conduit 28 may be connected to the leg of a T-connector (not shown) the arms of which are inserted into the flow line connected to an existing vacuum port on manifold 26. Other ways of connecting the second inlet to the intake manifold vacuum are entirely within the scope of ordinary mechanical skill.

Figure 2:
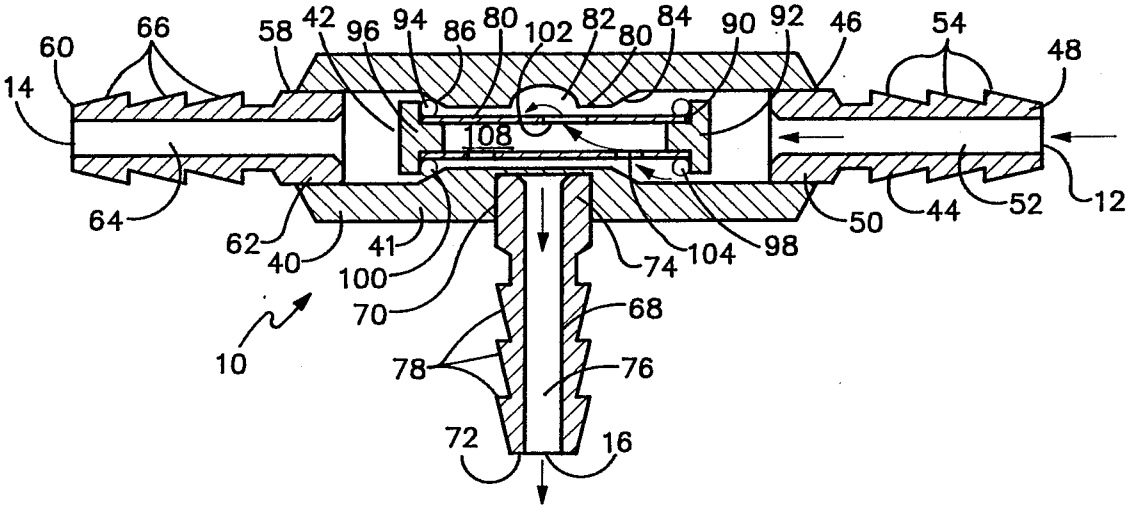
FIG. 2 is a cross-sectional view of the preferred embodiment of the control valve according to the present invention showing communication between a first inlet and the outlet.
Figure 3:
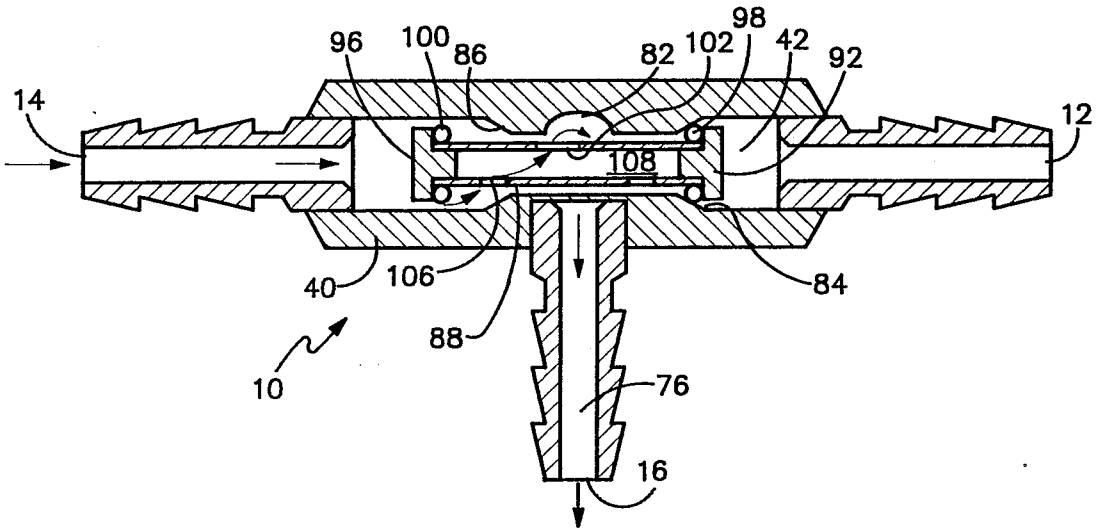
FIG. 3 is a cross-sectional view similar to FIG. 2 but showing the control valve in a second position establishing fluid communication between a second inlet and the outlet.
Figure 4:
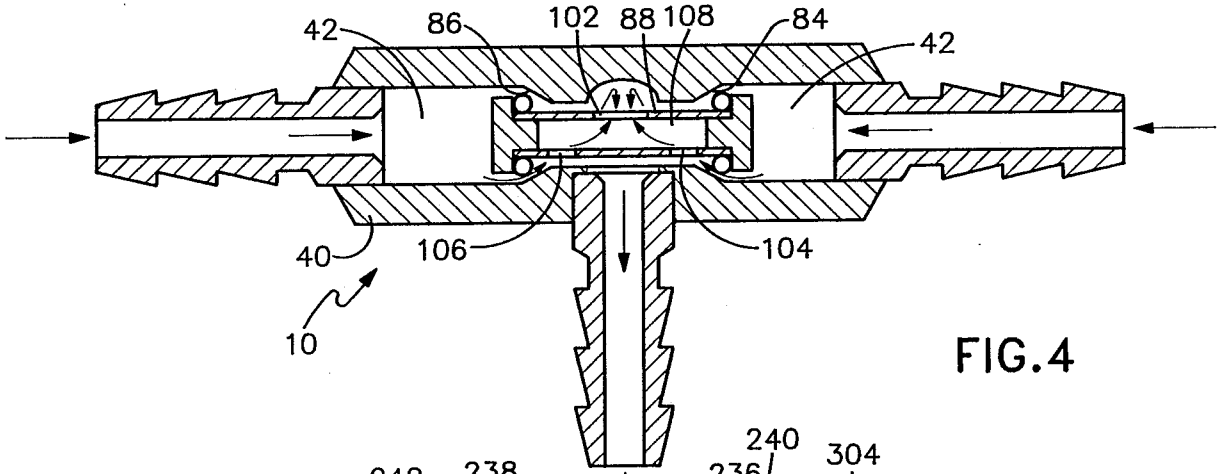
FIG. 4 is a cross-sectional view similar to FIGS. 2 and 3 showing the control valve according to the preferred embodiment of the present invention in an intermediate position.

The structure of the preferred embodiment of control valve 10 is best shown in reference to FIGS. 2–4. In these figures, it should be appreciated that control valve 10 includes a main body portion 40 which is in the form of an elongated tubular member having a flow passageway 42 formed axially therein. Body portion 40 is constructed of any suitable material, such as metal, and a first nipple 44 is press-fit into first end 46 of body portion 40 to form first inlet 12. To this end, nipple 44 has an outer end 48 and an enlarged inner end 50 which is matably received in a first end of passageway 42. Nipple 44 has an axial passageway 52 which fluidly communicates with passageway 42, and has an outer surface formed by a plurality of conical teeth 54 of a type used in the art so that nipple 44 may be matably received in the end of a rubber conduit. Similarly, a second nipple 56 is received in second end 58 of body portion 40. To this end, second nipple 56 has an outer end 60 and an inner end 62 which is matably engaged in passageway 42 at second end 58. Second nipple 56 has an axial passageway 64 formed therein with passageway 64 being in communication with flow passageway 42 to define second inlet 14. A plurality of conical teeth 66 are formed on the exterior surface of second nipple 56 and are operative to engage a conduit, again as is known in the art. Outlet 16 is formed by a third nipple 68 which is mounted in radial bore 70 formed through sidewall 41 of body portion 40. Thus, third nipple 68 has an outer end 72 that forms outlet 16 and an enlarged inner end 74 that is press-fit into bore 70. Passageway 76 extends axially through third nipple 68 transverse to passageway 42, and the outer surface of nipple 68 is formed as a plurality of conical teeth 78 operative to receive a rubber conduit.

As is shown in FIGS. 2–4, passageway 42 has a central portion 80 having a reduced cross-section and enlarged cavity 82 is located centrally of central portion 80. Cavity 82 intersects bore 70 so that cavity 82 is in fluid communication with outlet 16 through passageway 76. A pair of frustoconical wall portions are formed on either side of central portion 80 such that a first frustoconical wall portion forms a first valve seat 84, and the second frustoconical wall portion forms a second valve seat 86 with each of valve seats 84 and 86 facing their respective inlets 12 and 14, as is shown in FIGS. 2–4.

A first valve element 90 is positioned in passageway 42 between first inlet 12 and central portion 80 so that it is between the first inlet and outlet 16. First valve element 90 includes an end plug 92 which is received in one end of a spindle 88. Spindle 88 is an elongated tubular member extending longitudinally in passageway 42 and is sized to have a greater length than central portion 80. A second valve element 94 is formed by a second end plug 96 received in an end of spindle 88 opposite plug 92. A first gasket in the form of O-ring 98 is positioned around spindle 88 adjacent plug 90. Likewise, a second gasket in the form of O-ring 100 extends around spindle 88 adjacent plug 96.

With reference best to FIG. 4, it should be appreciated that spindle 88 includes a central port 102 and first and second outer ports 104 and 106 which communicate with hollow interior 108 of spindle 88. It should be appreciated from this description, then, that spindle 88 and end plugs 92 and 96 form first and second valve means which are mechanically connected to one another by means of spindle 88 for corresponding reciprocal motion in passageway 42. Furthermore, spindle 88 comprises inwardly projection tubular portions which not only are affixed to one another but also define guide means for aligning the first and second plugs as they move between an open and closed position, as described below.

Turning to the operation of the present invention, then, it should be understood that the valve means formed by spindle 88, plugs 92 and 96, and O-rings 98 and 100 operate to switch pressure connection of outlet 16 between the first and second inlets 12 and 14, depending upon which inlet has the greatest vacuum, i.e., lower relative pressure. For example, when the pressure of inlet 12 is lower than the pressure of inlet 14, this valve means moves into the position shown in FIG. 2. Here, since inlet 14 is at a greater pressure than inlet 12, the valve means moves to the right so that second valve element 94 seats against second valve seat 86 thereby prohibiting fluid flow between second inlet 14 and outlet 16. Since spindle 88 mechanically interconnects plug 92 to plug 96, the movement of spindle 88 into the position shown in FIG. 2 causes plug 92 and O-ring 98 to move away from valve seat 84 so that fluid communication is established around the plug 90 in the direction of the arrows shown in FIG. 2. Thus, inlet 12 communicates with interior 108 of spindle 88 through first outer port 104 which in turn communicates with cavity 82 through central port 102. Cavity 82, in turn, is in fluid communication with outlet 16 so that a flow passageway is established between first inlet 12 and outlet 16. Accordingly, outlet 16 is supplied with vacuum at the lower pressure of the vacuum at inlet 12.

Should the vacuum of inlet 14 be greater than the vacuum at inlet 12, that is, should inlet 14 be at a less pressure than inlet 12, the valve means formed by spindle 88 and plugs 92 and 94 moves toward the left, as is shown in FIG. 3. When this happens, the valve element unseats from second valve seat 86, and end plug 92 and O-ring 98 seat against first valve seat 84. In this position, fluid communication between inlet 12 and outlet 16 is prohibited while fluid communication between inlet 14 and outlet 16 is established in the direction of the arrows shown in FIG. 3. With greater specificity, inlet 14 is in fluid communication with passageway 42 and is in fluid communication with interior 108 of spindle 88 by means of second outer port 106. Again, interior 108 is in fluid communication with cavity 82 through central port 102, and cavity 82 is in fluid communication with outlet 16 through passageway 76. Accordingly, it is again seen that, should the vacuum of inlet 14 be greater than the vacuum of inlet 12, control valve 10 logically switches to the greater vacuum of inlet 14.

At such time when the vacuum at inlets 12 and 14 are approximately equal, small perturbations in the vacuum cause the valve means to toggle between the two inlets so that the effective vacuum supplied at outlet 16 is a combination of the two vacuum sources connected to inlets 12 and 14. It should be understood by the ordinarily skilled mechanic that the mass of spindle 88 and plugs 92 and 96 form an inertial mass which affects the transition time between the open and closed positions of the pair of valve elements. This blend of vacuums is best shown in FIG. 4 where both valve elements 90 and 94 are unseated respectively from first and second valve seats 84 and 86. Here, the interior 108 of spindle 88 is in fluid communication with passageway 42 on both sides of central portion 80 through outer ports 104 and 106. Thus, both inlets 12 and 14 communicate with interior 108 and are then in communication with cavity 82 through central port 102. Outlet 16 is thus in communication with both inlets 12 and 14 through passageway 76.

Figure 5:
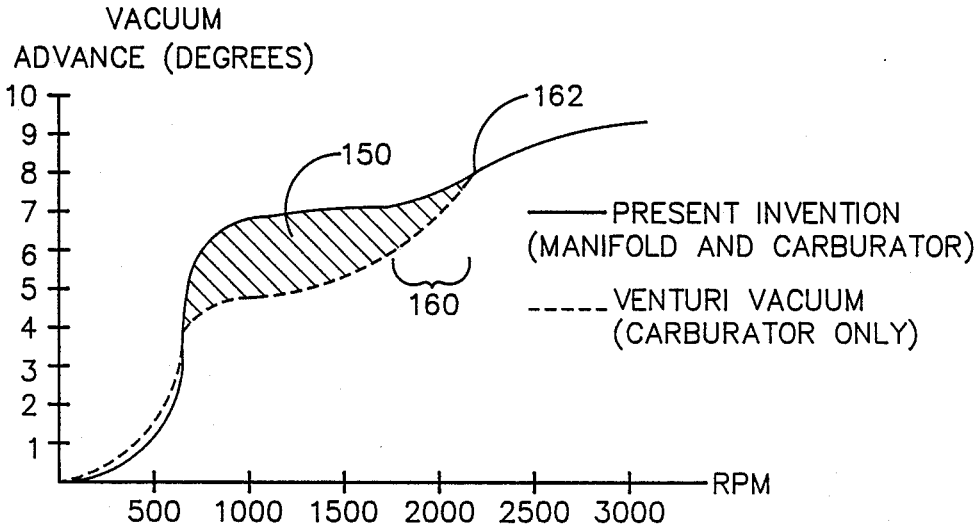
FIG. 5 is a graph showing the vacuum advance of the present invention used with an internal combustion engine as compared with the vacuum advance of the venturi vacuum only as used in the prior art.

It should be appreciated from the foregoing that the present invention, when used in conjunction with an internal combustion engine, not only provides increased efficiency for the engine but also substantially reduces the emission of carbon monoxide and hydrocarbons by advancing the spark while the vehicle is idling. Prior to the present invention, the vacuum advance of a vehicle was typically hooked directly to the vacuum venturi of the carburetor. FIG. 5 shows the vacuum advance in degrees as function of the revolution per minute (rpm) for a representative vehicle, by way of example. The prior art method and apparatus is shown in a dotted line 120 where the vacuum advance is relatively flat from an idle point 156' of approximately 700° rpm until the engine runs at sufficient revolutions to increase the venturi vacuum enough to advance the spark. Thus, from approximately 1,500 rpm's and above for the representative vehicle, the vacuum advance is fairly directly dependent upon the rpm of the engine. In this example, though, substantial pollutants are emitted at the lower end of the scale since the engine is burning too rich. At these rpm's also, the engine burns less efficiently.

With the vacuum control valve according to the present invention, though, vacuum advance is caused by the greater of the intake manifold vacuum and the venturi vacuum. In FIG. 5 for the representative vehicle, this is diagrammed as the solid line 130. For rpm's greater than 700 and less than 1,500 rpm, in the example, the manifold vacuum is greater so that the vacuum advance is greater than in the traditional system shown in the dotted line. However, at approximately 1,500 rpm's , the strength of the venturi vacuum overtakes the intake manifold vacuum so that the vacuum advance becomes dominated by the venturi vacuum. Thus, a shaded region 150 is shown which corresponds to that region wherein the intake manifold dominates the venturi vacuum to increase the efficiency of the engine and to reduce the pollutant emission. The skilled person in this art will recognize that a substantial percentage of automobile time is spent at these lower rpm's. Naturally, the exact shape of the curves, their intersections and amount of vacuum advance will vary for different vehicles.

Figure 6:
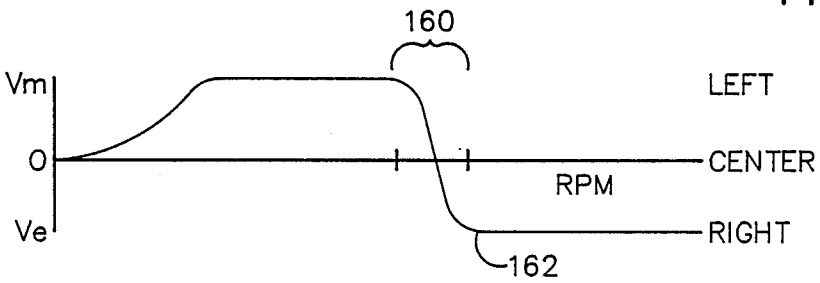
FIG. 6 is a graph showing the toggling of the control valve as it relates to the vacuum advance of FIG. 5.

FIG. 6 shows, for comparison purposes with FIG. 5, the position of spindle 88 according to which valve is open in the representative example. In FIG. 6, then, when the engine is started and idles, the spindle initially moves to the position shown in FIG. 3 at idle point 156 so that the vacuum advance is dominated by the intake manifold vacuum $V_m$ of the engine rather than the vacuum venturi. As the rpm increases, control valve 10 reaches a transition point 158 at the start of transition zone 160 wherein the valve means begins to toggle between the intake manifold and the vacuum venturi. Due to the inertial mass of the system, this transition zone while having a fairly steep slope, is nonetheless not abrupt since a vacuum equilibrium condition exists between the manifold vacuum and the venturi vacuum until such time that the rpm of the engine increases so that the venturi vacuum dominates at the point 162 at the end of transition zone 160. For higher rpm's, the control valve 10 is in position such that the vacuum advance is subjected totally to the vacuum venturi or $V_c$. The inertial mass and the toggle ability of the control valve help smooth the transition zone 160 both during acceleration and deceleration of the vehicle's engine. As is well known, these conditions can occur in a variety of driving situations, including idling, gear shifting, engine braking and the like.

Figure 7:
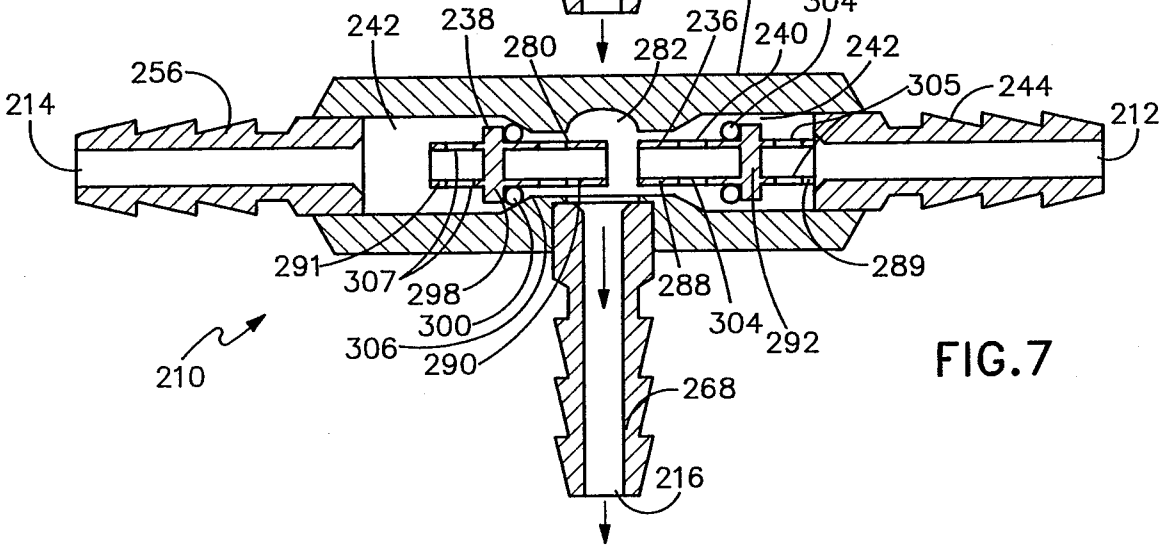
FIG. 7 is cross-sectional view of an alternate embodiment of the control valve according to the present invention in a first position.
Figure 8:
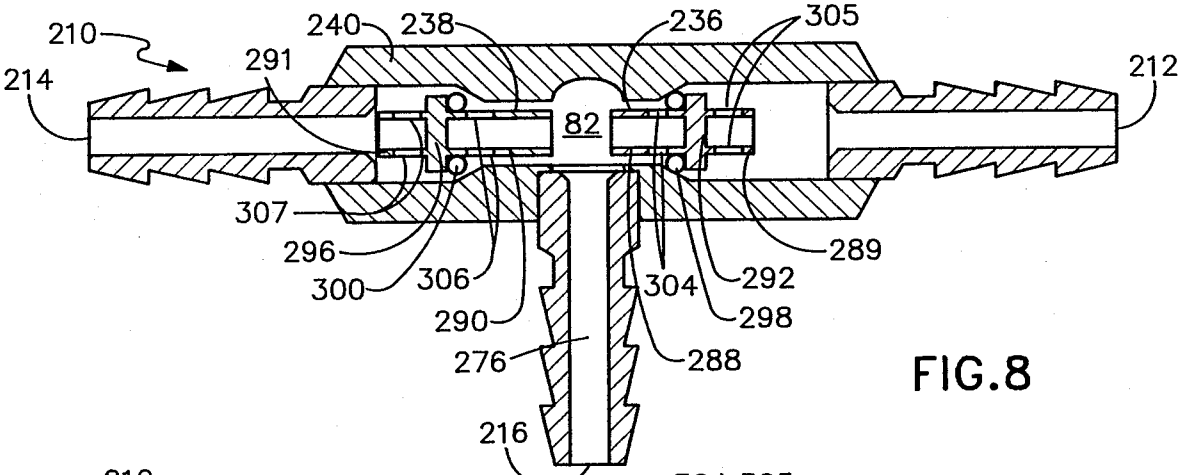
FIG. 8 is a cross-sectional view of a control valve shown in FIG. 7 in a second position.
Figure 9:
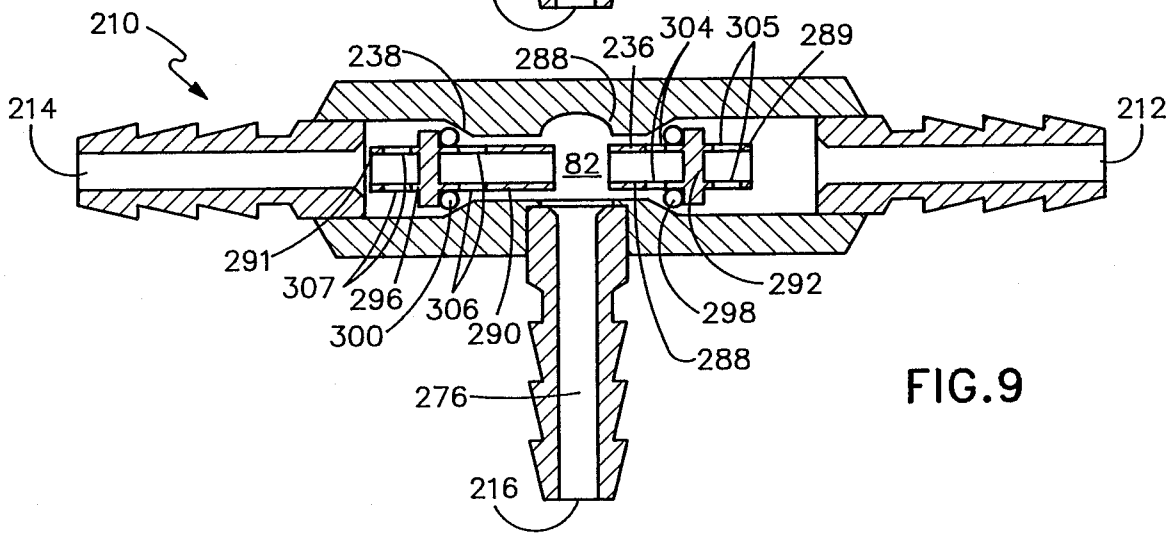
FIG. 9 is a cross-sectional view of the control valve shown in FIGS. 7 and 8 in an intermediate position.

An alternate embodiment of the present invention is shown in FIGS. 7, 8 and 9. In these figures, a vacuum control valve is shown and is constructed substantially identically as valve 10 with the exception of the valve means. Accordingly, for purposes of reviewing FIGS. 7–9, the structure of body portion 240 is the same as body portion 40 with body portion 240 having a passageway 242 formed longitudinally therein. Passageway 242 is similar in configuration to passageway 42 described above. Likewise, first inlet 212, second inlet 214 and outlet 216 are configured the same with respect to the description of the preferred embodiment along with the construction of their respective nipples 244, 256 and 268.

The embodiment of the present invention shown in FIGS. 7–9 departs from the preferred embodiment by having two independent valve elements 236 and 238. First valve element 238 includes an end plug 292 that is formed as part of a hollow spindle portion 288 that projects away from plug 292 axially in passageway 242 toward cavity 282 formed centrally of central portion 280. Valve element 238 is provided with a second, outer spindle portion 289 that is connected to and projects from plug 292 opposite spindle portion 288. An O-ring 298 is mounted around spindle portion 288 adjacent plug 292 and forms a gasket means for valve element 236. Spindle portion 288 is provided with a pair of inner ports 304 adjacent plug 292. Spindle portion 289 is provided with a pair of outer ports 305 adjacent plug 292. Similarly, second valve element 238 has an end plug 296, an inner spindle 290 and an outer spindle portion 291, each projecting axially of control valve 210 in passageway 242. Spindle portion 290 projects inwardly from plug 296 toward cavity 292 while spindle portion 291 projects outwardly from plug 296 toward inlet 214. An O-ring 300 forms a gasket for valve element 238 and is located on spindle portion 290 adjacent plug 296. Valve element 238 is provided with a pair of inner ports 306 in spindle portion 290 adjacent plug 296. Spindle portion 291 is provided with a pair of ports 307 adjacent plug 296.

The operation of control valve 210 may now be more readily appreciated with respect ot FIGS. 7–9. When a vacuum at first inlet 212 is greater than the vacuum at inlet 214, first valve element 236 is pulled away from first valve seat 284 until spindle portion 289 abuts an inner end of nipple 244; at the same time, second valve element 238 seats against its second valve seat 286, all as is shown in FIG. 7. In this position, outlet 216 is isolated from inlet 214 but is in fluid communication with inlet 212. To this end, a fluid flow passes through inlet 212, and into passageway 242 through ports 305. Flow may then take place around plug 292 and into the interior of spindle portion 288 through ports 304 after which the flow may pass through cavity 282 and outlet 216.

Contrariwise, when the vacuum on inlet 214 is greater than the vacuum on 212, valve element 236 moves into a position so that O-ring 298 seats against first valve seat 284 while valve element 238 moves out of seated engagement with second valve seat 286 with spindle portion 291 abutting an inner end of nipple 250. This establishes fluid flow between inlet 214 and outlet 216 in a manner similar to that described above while at the same time fluid communication is prohibited with inlet 212. This configuration is shown in FIG. 8.

FIG. 9 shows a transition condition wherein the vacuum on inlets 212 and 214 ar substantially equal so that each of valve elements 236 and 238 float and may seat and unseat against their respective valve seats 284 and 286. In this transition condition, the vacuum supplied to outlet 216 may be either of the vacuums from inlets 212, and 214, or may be a combination of the two vacuum signals. It should be appreciated that spindle portions 288, 289, 290 and 291 are provided to guide the movement of each of valve elements 236 and 238 during their opening and closing and that spindle portions 289 and 291 also provide limit stops defining the maximum open position for their respective valve elements.

In either of the embodiments when used on an engine driven vehicle, the control valve is first mounted as described above after the engine has been tuned. The vehicle is then allowed to idle and the idle fuel mixture is leaned to reduce the idle speed of the engine to normal rpm. It is important that the idle speed not be adjusted by means of the throttle idle screw as this merely varies the flow rate of the mixed fuel product and not the composition of gasoline/air forming the mixed fuel product. With these adjustments completed, the vacuum is advanced for idle and low speeds according to the intake manifold pressure and at greater speeds according to the vacuum venturi. The engine thus runs more efficiently and is less polluting over its entire operative range.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

We claim:

1. In an engine driven vehicle having an internal combustion engine with an intake manifold, a carburetor with a vacuum venturi and an ignition system with a vacuum advance normally connected to the vacuum venturi, a vacuum control valve comprising:

a body portion having an internal flow passageway communicating with a first inlet, a second inlet and an outlet;

first means for securing a first conduit in fluid communication with said first inlet, said first conduit being secured in fluid communication with the vacuum venturi to establish a pressure connection between the vacuum venturi and the passageway through the first inlet;

second means for securing a second conduit in fluid communication with said second inlet, said second conduit being secured in fluid communication with the intake manifold to establish a pressure connection between the intake manifold and the passageway through the second inlet;

third means for securing a third conduit in fluid communication with said outlet, said third conduit being secured in fluid communication with the vacuum advance to establish a pressure connection between the vacuum advance and the passageway through the outlet; and a first valve element associated with said first inlet and a second valve element associated with said second inlet, each of said first and second valve elements having an open position establishing communication between the respective one of the first and second inlets and said outlet, said first valve element moving into the open position and said second valve element moving to a closed position when the pressure of the vacuum venturi is less than the pressure of the intake manifold and said first valve element moving into the closed position and said second valve element moving into the open position when the pressure of the intake manifold is less than the pressure of the vacuum venturi so that the vacuum advance is in fluid communication with whichever one of the vacuum venturi and intake manifold is at the lower relative pressure said first and second valve elements constructed to include an inertial mass operative to affect the rate of transition between the open and closed positions.

2. In an engine driven vehicle having an internal combustion engine with an intake manifold, a carburetor with a vacuum venturi and an ignition system with a vacuum advance normally connected to the vacuum venturi, a vacuum control valve comprising:

a body portion having an internal flow passageway communicating with a first inlet, a second inlet and an outlet;

first means for securing a first conduit in fluid communication with said first inlet, said first conduit being secured in fluid communication with the vacuum venturi to establish a pressure connection between the vacuum venturi and the passageway through the first inlet;

second means for securing a second conduit in fluid communication with said second inlet, said second conduit being secured in fluid communication with the intake manifold to establish a pressure connection between the intake manifold and the passageway through the second inlet;

third means for securing a third conduit in fluid communication with said outlet, said third conduit being secured in fluid communication with the vacuum advance to establish a pressure connection between the vacuum advance and the passageway through the outlet;

a first valve element associated with said first inlet and a second valve element associated with said second inlet, each of said first and second valve elements having an open position establishing communication between the respective one of the first and second inlets and said outlet, said first valve element moving into the open position and said second valve element moving to a closed position when the pressure of the vacuum venturi is less than the pressure of the intake manifold and said first valve element moving into the closed position and said second valve element moving into the open position when the pressure of the intake manifold is less than the pressure of the vacuum venturi so that the vacuum advance is in fluid communication with whichever one of the vacuum venturi and intake manifold is at the lower relative pressure; and, means for mechanically coupling said first and second valve elements to one another.

3. In an engine driver vehicle having an internal combustion engine with an intake manifold, a carburetor with a vacuum venturi and an ignition system with a vacuum advance normally connected to the vacuum venturi, a vacuum control valve comprising:

a body portion having an internal flow passageway communicating with a first inlet, a second inlet and an outlet;

first means for securing a first conduit in fluid communication with said first inlet, said first conduit being secured in fluid communication with the vacuum venturi to establish a pressure connection between the vacuum venturi and the passageway through the first inlet;

second means for securing a second conduit in fluid communication with said second inlet, said second conduit being secured in fluid communication with the intake manifold to establish a pressure connection between the intake manifold and the passageway through the second inlet;

third means for securing a third conduit in fluid communication with said outlet, said third conduit being secured in fluid communication with the vacuum advance to establish a pressure connection between the vacuum advance and the passageway through the outlet;

including a first valve element associated with said first inlet and second valve element associated with said second inlet each of said first and second valve elements having an open position establishing communication between the respective one of the first and second inlets and said outlet, said first valve element moving into the open position and said second valve element moving to a closed position when the pressure of the vacuum venturi is less than the pressure of the intake manifold and said first valve element moving into the closed positin and said second valve element moving into the open position when the pressure of the intake manifold is less than the pressure of the vacuum venturi in such a manner that the vacuum advance is in fluid communication with whichever one of the vacuum venturi and intake manifold is at the lower relative pressure; and, a hollow spindle having an interior, a first plug forming said first valve element and second plug forming said second valve element, said passageway having a first valve seat for said first plug and a second valve seat for said second plug, said spindle having a first port adjacent said first plug whereby flow is established around said first plug and into the interior of the spindle when the first plug moves away from the first valve seat to define the open position for the first valve element and a second port adjacent said second plug whereby flow is established around said second plug and into the interior of the spindle when the second plug moves away from the second valve seat to define the open position for the second valve element and a central port communicating with said outlet whereby flow is established between said outlet and the interior of the spindle.

4. A vacuum control valve according to claim 3 wherein said passageway is enlarged at a region around a central portion of said spindle to form a cavity through which said spindle extends, said outlet communicating with said cavity.

5. A vacuum control valve operative to connect a first and second vacuum source to a vacuum use station, comprising:

a first body portion having an internal flow passageway, a first inlet for said flow passageway connectable in fluid communication with the first vacuum source, a second inlet for said flow passageway connectable in fluid communication with the second vacuum source and an outlet for said flow passageway connectable in fluid communication with the vacuum use station whereby pressure connection is made between said vacuum use station and each of said first and second vacuum sources through said flow passageway;

a first valve means in said flow passageway between said first inlet and said outlet and having an open position for permitting communication between said first inlet and the outlet through said flow passageway and a closed position prohibiting communication between said first inlet and the outlet through said flow passageway; and a second valve means in said flow passageway between said second inlet and said outlet and having an open position for permitting communication between said second inlet and the outlet through said flow passageway and the closed position prohibiting communication between said second inlet and the outlet through said flow passageway;

said first and second valve means responsive to the relative pressures of said first and second vacuum sources whereby said first valve means is in the open position and the second valve means is in the closed position when the vacuum of the first vacuum source is greater than the vacuum of the second vacuum source and whereby said first valve means is in the closed position and the second valve means is in the open position when the vacuum of the second vacuum source is greater than the vacuum of the first vacuum source.

6. A vacuum control valve according to claim 5 wherein said body portion is elongated in shape with said passageway formed longitudinally therein, said first and second inlets being located on opposite ends of said passageway and said outlet located centrally of said passageway.

7. A vacuum control valve according to claim 6 wherein said passageway has a reduced diameter along a central portion thereof to form first and second valve seats facing said first and second inlets, respectively, said first valve means formed by a first valve element constructed with a first plug sized to seat against said first valve seat in the closed position and movable in said passageway away from said first valve seat and toward said first inlet to define the open position, said second valve means formed by a second valve element constructed with a second plug sized to seat against said second valve seat in the closed position and movable in said passageway away from said second valve seat and toward said second inlet to define the open position.

8. A vacuum control valve according to claim 7 including first gasket means on one of said first plug and first valve seat for increasing the seal therebetween, and second gasket means on one of said second plug and second valve seat for increasing the seal therebetween.

9. A vacuum control valve according to claim 7 including first and second guide means respectively on said first and second valve elements for respectively aligning said first and second plugs as each plug moves between the open and closed positions.

10. A vacuum control valve according to claim 9 wherein said first and second guide means include first and second spindle portions respectively connected to said first and second plugs and projecting toward one another into the central portion of the passageway.

11. A vacuum control valve according to claim 10 wherein said first and second spindle portions are tubular having a port formed adjacent a respective plug.

12. A vacuum control valve according to claim 11 wherein said first and second guide means further includes first and second tubular guide elements connected to a respective plug and projecting oppositely of a respective spindle portion, each of said guide elements having an open outer end and a vent port formed adjacent its respective plug.

13. A vacuum control valve according to claim 11 wherein said first and second spindle portions are attached to one another to form a common spindle element having a hollow interior and mechanically joining said first and second plugs for common reciprocal movement in said passageway, said spindle element having a larger longitudinal length than the central portion of the passageway and including a central port whereby said outlet is in fluid communication with the interior of the spindle.

14. A vacuum control valve according to claim 13 wherein the passageway includes an enlarged cavity centrally located thereof, said outlet extending radially outwardly of said cavity.

15. A vacuum control valve according to claim 5 wherein said body portion includes a first nipple communicating with said first inlet, a second nipple communication with said second inlet and a third nipple communicating with said outlet, said first, second and third nipples operative to receive and secure tubular conduits to said control valve to interconnect said control valve to said first and second vacuum sources and to said vacuum use station.

16. A vacuum control valve according to claim 15 wherein said first vacuum source is a carburetor vacuum venturi, said second vacuum source is an intake manifold and said vacuum use station is a vacuum advance for an ignition system on an engine-driven vehicle.

* * * * *